United States Patent [19]

Dolan

[11] 4,131,958

[45] Jan. 2, 1979

[54] DISPENSATION OF CONCENTRATED SOLUTION INTO TOILET FLUSH TANK

[76] Inventor: John E. Dolan, 7 Maple Ave., Haverstraw, N.Y. 10927

[21] Appl. No.: 684,613

[22] Filed: May 10, 1976

[51] Int. Cl.[2] ..... E03D 9/02

[52] U.S. Cl. ..... 4/227; 4/228

[58] Field of Search ..... 4/222, 227, 228; 222/477, 564

[56] References Cited

U.S. PATENT DOCUMENTS

| | | | |
|---|---|---|---|
| 2,065,181 | 12/1936 | French | 4/227 |
| 2,688,754 | 9/1954 | Willits et al. | 4/228 |
| 3,019,451 | 2/1962 | Wooldridge | 4/228 |
| 3,177,502 | 4/1965 | Meunier | 4/228 |
| 3,874,007 | 4/1975 | Dolan | 4/228 |

*Primary Examiner*—Stuart S. Levy

*Attorney, Agent, or Firm*—Beveridge, DeGrandi, Kline & Lunsford

[57] ABSTRACT

Toilet disinfectant liquid is dispensed from an inverted container suspended within a toilet tank. As the toilet tank is refilled at the conclusion of a flush cycle, an inverted cup entraps air which then enters the container through a narrow elongated passage which prevents tank water from entering the container. When the water level in the tank falls during the succeeding flush cycle, disinfectant liquid passes through the narrow elongated passage and into the toilet tank. Bubbles formed in the elongated passage prevent continued dispensation of the disinfectant.

14 Claims, 5 Drawing Figures

DISPENSATION OF CONCENTRATED SOLUTION INTO TOILET FLUSH TANK

BACKGROUND AND SUMMARY OF THE INVENTION

This invention relates to the dispensation of a disinfectant or deodorant solution into the contents of a toilet flush tank. Devices of this general type are well-known and commercially available and operate on several different principles. In some, a solid water soluble disinfectant is postioned at the bottom of a flush tank where it is dissolved by the water in the flush tank. Other dispensers provide a concentrated solution, typically a disinfectant or deodorant solution, which is released periodically into the contents of the toilet flush tank. Release of the concentrated solution may be produced by a float-operated pump, pressure created by air rising in an air-entrapment chamber, external pressure reduction caused by a receding water level during the flush phase of the toilet flush-and-refill cycle or other means. Liquid has been dispensed through spouts, perforations or tubes, an example of the latter being found in U.S. Pat. No. 2,688,754 which also uses an air entrapment chamber.

This invention is an improvement to the device shown in my earlier U.S. Pat. No. 3,874,007 which disclosed an inverted air entrapment chamber supporting a vertical stem with carried a dilution vessel at its lower end. The improvement relates to the provision of an air-inflow, liquid-outflow passage in the container.

It is an object of this invention to provide a simple, inexpensively manufactured means for dispensing a concentrated solution into the contents of a toilet flush tank. According to the invention, a downwardly-open air-entrapment chamber is located in the outlet opening of the container for the concentrated solution. A tube extends upwardly from the upper end of the air entrapment chamber into the container. A plug provided with elongated grooves is snugly fit within the tube, the elongated grooves providing narrow elongated passages between the tube and the plug, these passages admitting air into the container as the water level rises in a toilet tank, and permitting dispensation of concentrated liquid as the water level falls. Preferably, the lower end of the plug is provided with a tip portion which supports a decending film of the concentrated solution, serving to delay introduction of the concentrated solution into the toilet tank water.

The invention herein may take many forms, but a preferred one is shown in the following drawings and description.

BRIEF DESCRIPTION OF A PREFERRED EMBODIMENT

Figure 1:
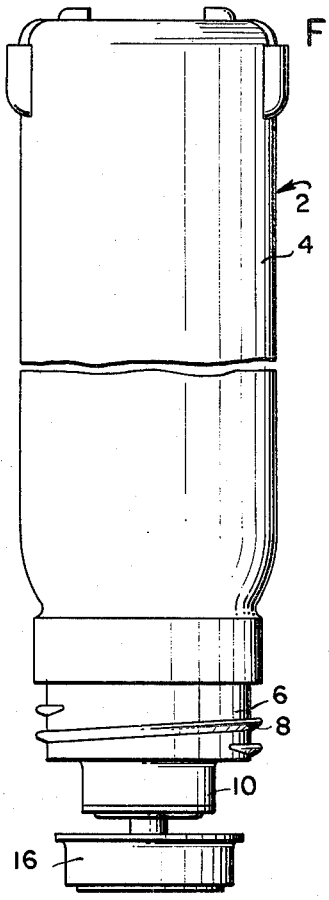
FIG. 1 is an elevational view of the preferred form of a toilet disinfectant dispenser in its operative position.
Figure 4:
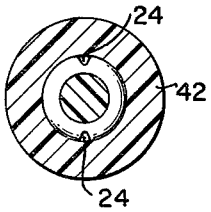
FIG. 4 is a sectional view taken along the line 4—4 in FIG. 3.
Figure 5:
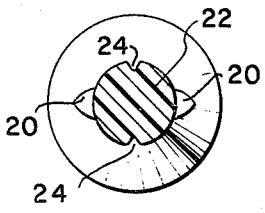
FIG. 5 is a sectional view taken along the line 5—5 in FIG. 3.
Figure 2:
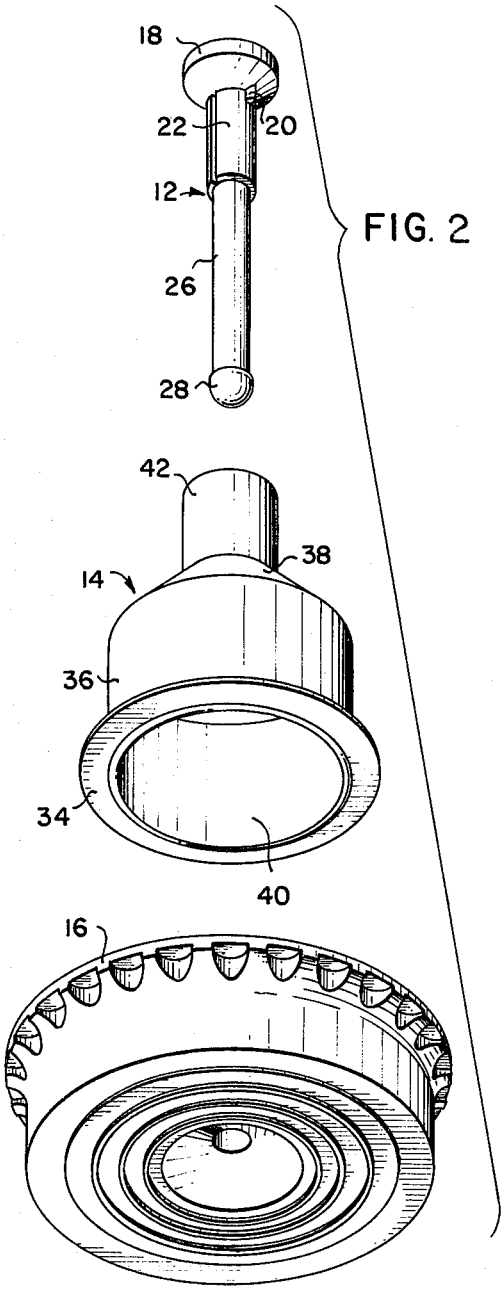
FIG. 2 is an exploded view of the elements which produce the desired dispensing activity.

FIG. 1 shows a dispenser 2 having a disinfectant container 4 in an operative inverted orientation, as it is held in a toilet tank by means of a conventional hook or clip attached to the bottle in any known manner. The container may be flexible or rigid, plastic or glass, but it preferably is a blow-molded polyethylene bottle.

Figure 3:
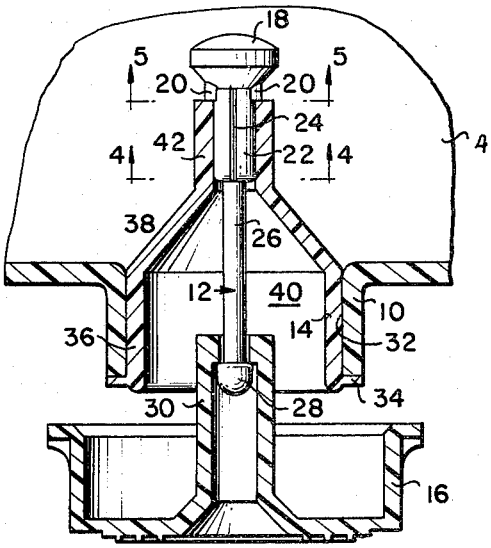
FIG. 3 shows the elements of FIG. 2 in their assembled position in the neck of a disinfectant container.

At the lower end of the container 4, there is an enlarged neck portion 6 with threads 8 for engaging the internal threads of a cap which seals the container during transportation and storage prior to installation in a toilet tank. A reduced neck portion 10 at the lower end of the container 4 provides the outlet opening through which disinfectant material is dispensed. The dispensation of disinfectant material is governed by three interconnected members which are inserted in the reduced neck portion 10 of the bottle. These members are the stem 12, the cup-and-tube member 14 and the optional dilution cup 16. The assembled and operative relationship between these members is best illustrated in FIG. 3 where it will be seen that the cup and tube member 14 is held in the outlet opening of container 4, the upper end of the stem is retained by the upper tube portion of member 14, and the dilution cup 16 is supported on the lower end of the stem 12.

The integral cup-and-tube member 14 is sealingly engaged within the outlet opening 32 at the lower portion of the container 4. The member 14 has a radial flange 34 at its lower end to establish its position in the neck of the container. A cylindrical wall 36 and a conical wall 38 form an inverted cup defining a downwardly open air-entrapment chamber 40 in the outlet opening of the container. Chamber 40 entraps air as the water level rises in toilet tank. The conical wall 38 of the cup converges upwardly to the tube section 42 of the member 14 so that rising water in a toilet tank is prevented from entering the tube 42 when any air remains entrapped in the chamber 40.

At the upper end of the stem 12 there is an enlarged head 18, stop means 20 and a plug section 22 provided with two diametrically opposed vertically elongated grooves 24. The stem 12 also has an elongated tip portion 26 which is longer than the plug section 22 and has an exterior surface extending downwardly from the lower end of the groove 24 to support a downwardly moving film of disinfectant when the water in the toilet tank recedes. An enlarged head 28 at the lower end of the tip portion 26 supports the upper end of a central sleeve 30 of the dilution vessel 16. The dilution vessel is slidable on the tip portion 26 to enable the dispensing assembly to collapse for size-reduction during shipment and storage.

The plug section 22 of the stem 12 is frictionally engaged in the tube portion 42 of member 14, so that the grooves 24 provide a narrow elongated passage between the upper portion of the air entrapment chamber 40 and the interior of the container. The width of each of the grooves 24, measured circumferentially of the plug 22 is about 0.01 inch (0.25 mm) and preferably is 0.008 inch (0.2 mm). It should be no more than about 0.02 inch. The length of the elongated passage formed by the grooves is at least about 0.2 inch (5 mm) and is preferably 0.25 inch (6 mm).

In order to assure that the upper ends of the elongated grooves 24 remain in communication with the interior of the container 4, the stops 20 abut the upper end of the tube 42 at a point which is laterally offset from the upper ends of the grooves. This placement of the stops 20 does not impede the flow of fluid to the grooves 24. The lower end of the elongated passage formed by groove 24 between the plug portion 22 and tube 42 is at an elevation at least as high as the uppermost end of the inverted cup to prevent rising water from entering the groove 24.

One function of the elongated tip 26 of the stem 12 is to delay the release of disinfectant solution into the toilet tank water, to avoid dispensation of all disinfectant during the flush phase of the cycle rather than during the refill phase of the cycle. Dispensation is also delayed by the provision of the optional dilution cup 16 supported by head 28 at the lower end of the tip portion 26. The complete function of such a dilution vessel is discussed in my earlier U.S. Pat. No. 3,874,007 which is incorporated herein in its entirety by reference. The dilution vessel 16 is oriented to retain a quantity of toilet tank water after the water level recedes below the disinfectant dispensing device. As the water level drops, dispensed disinfectant runs down the stem 26 into the vessel 16. Then, when the water level rises again to the disinfectant dispenser, the toilet tank contents will come into communication and mix with the diluted disinfectant solution in the vessel 16.

When the device is first inverted when placed in a toilet tank, a quantity of concentrated solution will flow downwardly through the grooves 24 to create a partial vacuum within the container 4. In operation, the elements of the device always appear as shown in FIG. 3, except that on occasions the dilution cup 16 may slip upwardly on the tip portion 26 of the stem 12. When the toilet tank is substantially empty at the end of a flush cycle, the toilet flush valve will close and the refill valve will open, commencing the refill cycle when water is introduced into the toilet tank. The water level will rise to the level of the dilution vessel 16, causing any diluted disinfectant on tip 26, head 28 or in the vessel 16 to mix with the toilet tank water. When the water level rises to the lower end of the member 14, air will be entrapped within the chamber 40. As the water level continues to rise, the pressure of the entrapped air will increase, causing some air to be driven through the groove 24 to reduce the partial vacuum and equalize the pressure. The elongated passage resists the movement of air therethrough, and the air will assume the form of bubbles surrounded by any disinfectant solution remaining in the groove 24. These bubbles prevent concentrated solution from being dispensed and prevent water from entering the container to dilute the solution. Access of water to the groove is also detered by the upward convergence of the inclined wall 38 of the air entrapment chamber which causes a portion of the entrapped air to be directed to the lower end of the passage formed by grooves 24.

When the toilet is again flushed, the water level in the toilet tank recedes, reducing the pressure in the air entrapment chamber 40 and causing disinfectant to flow downwardly through the groove 24. The volume of disinfectant solution dispensed is dependent upon the size, length and number of passages formed by grooves 24, and is independent of the volume of the chamber 40. The disinfectant flows along the tip portion 26 of stem 12 and into the dilution cup 16. Even when the dilution cup 16 is eliminated from the device, at least a major portion of the disinfectant solution will remain on the stem 12 as its rounded lower end 28 provides an enlarged surface area with no edges which would cause the release of droplets. Bubbles of air remaining within the groove 24 prevent undue dispensation of disinfectant after the water level recedes below the lower edge of the air entrapment chamber 40.

Persons skilled in this art will realize that the invention may be practiced by many means other than the specific ones disclosed herein. Therefore, it is emphasized that the invention is not limited only to the sole disclosed embodiment, but encompasses modifications thereto and variations thereof within the scope and spirit of the claims which follow. In the interest of clarity rather than limitation, the claims describe the elements in their positions of normal use, i.e. with the container in its inverted orientation. The claims encompass such devices in other orientations which they may assume during storage and shipment.

I claim:

1. A device for dispensing a concentrated solution into a toilet flush tank comprising
   - a closed container for said concentrated solution, said container having an outlet opening at a lower portion thereof,
   - a downwardly-open air-entrapment chamber in said outlet opening for entrapping air as the water level rises in the toilet tank, and
   - a tube extending upwardly from the upper portion of the air-entrapment chamber,
   - a plug snugly fitted within the tube,
   - a groove providing a narrow elongated passage between said tube and said plug communicating between an upper portion of the air-entrapment chamber and the interior of said container to prevent water from entering the container as the water level rises.

2. The device of claim 1 wherein the lower end of said elongated passage is at an elevation at least as high as the uppermost end of said air-entrapment chamber to prevent rising water from entering the passage.

3. The device of claim 1 having a stem which includes said plug, said stem having radially enlarged stop means abutting the upper end of said tube at a point laterally offset from the upper end of said groove whereby the upper end of the groove is in communication with the interior of the container.

4. The device of claim 1 wherein the air-entrapment chamber has an upper portion which is inclined and converges upwardly to the lower end of said tube, whereby rising water in a toilet tank is prevented from reaching said tube when any air remains within said air-entrapment chamber.

5. The device of claim 1 having a stem which includes said plug, said stem having an elongated tip portion extending downwardly from said plug, said tip portion having an exterior surface extending downwardly from said groove to provide a surface for supporting a downwardly-moving film of concentrated solution when the level of water in the toilet tank recedes.

6. The device of claim 5 having an upwardly-open dilution vessel supported on the lower end of said stem to receive concentrated solution for mixture with water retained by said dilution vessel.

7. The device of claim 1 wherein the transverse dimension of the elongated passage is no more than about 0.02 inch whereby said elongated passage resists the upward flow of air therethrough and causes air in the elongated passage to form bubbles with the concentrated liquid therein.

8. The device of claim 7 wherein the air-entrapment chamber has an upper portion which is inclined and converges upwardly to the lower end of said tube, whereby rising water in a toilet tank is prevented from reaching said tube when any air remains entrapped in said air-entrapment chamber.

9. The device of claim 7 wherein the lower end of said elongated passage is at an elevation at least as high as the uppermost end of said air-entrapment chamber to prevent rising water from entering the passage.

10. The device of claim 9 wherein the air-entrapment chamber has an upper portion which is inclined and converges upwardly to the lower end of said tube, whereby rising water in a toilet tank is prevented from reaching said tube when any air remains entrapped in said air-entrapment chamber.

11. The device of claim 7 having a stem which includes said plug, said stem having radially enlarged stop means abutting the upper end of said tube at a point laterally offset from the upper end of said groove whereby the upper end of the groove is in communication with the interior of the container.

12. The device of claim 7 wherein said stem has an elongated tip portion extending downwardly from said plug, said tip portion having an exterior surface extending downwardly from said groove to provide a surface for supporting a downwardly-moving film of concentrated solution when the level of water in the toilet tank recedes.

13. The device of claim 12 having an upwardly-open dilution vessel supported on the lower end of said stem to receive concentrated solution for mixture with water retained by said dilution vessel.

14. A method of dispensing a concentrated solution from a closed container into a toilet tank comprising the steps of positioning an empty inverted cup in the path of rising water in a toilet tank, raising the water level into the tank beyond the inverted cup to entrap air in the inverted cup, moving air so entrapped into and through a narrow elongated passage into the container, said elongated passage containing concentrated solution causing air in the narrow elongated passage to form bubbles therein, lowering the water level in the tank to reduce the pressure at the lower end of the narrow elongated passage and to move said bubbles surrounded by concentrated solution into the inverted cup for release into the toilet tank water, retaining at least one of said bubbles in said narrow elongated passage to prevent gravitational discharge of concentrated solution from the container into the toilet tank.

* * * * *